United States Patent [19]

Fujii

[11] Patent Number: 4,863,297

[45] Date of Patent: Sep. 5, 1989

[54] THERMAL PRINTER

[75] Inventor: Iwao Fujii, Osaka, Japan

[73] Assignee: Minolta Camera Kabushiki Kaisha, Osaka, Japan

[21] Appl. No.: 152,425

[22] Filed: Feb. 4, 1988

[30] Foreign Application Priority Data

Feb. 4, 1987 [JP] Japan ..... 62-23999

[51] Int. Cl.[4] ..... B41J 35/36

[52] U.S. Cl. ..... 400/249; 400/120; 400/174; 400/149

[58] Field of Search ..... 400/249, 120, 174, 149

[56] References Cited

U.S. PATENT DOCUMENTS

| | | | |
|---|---|---|---|
| 2,821,284 | 1/1958 | Garwood et al. | 400/249 X |
| 4,586,834 | 5/1986 | Hachisuga et al. | 400/120 |
| 4,595,303 | 6/1986 | Kuzaya et al. | 400/149 X |

FOREIGN PATENT DOCUMENTS

| | | | |
|---|---|---|---|
| 225978 | 12/1984 | Japan | 400/249 |
| 236779 | 11/1985 | Japan | 400/249 |
| 250983 | 12/1985 | Japan | 400/249 |
| 61-29561 | 2/1986 | Japan | 400/120 |
| 4084 | 1/1988 | Japan | 400/249 |

OTHER PUBLICATIONS

Research Disclosure, "Printer with One Page End of Ribbon Warning", Mar. 1986, No. 263, p. 26301.

*Primary Examiner*—Edgar S. Burr
*Assistant Examiner*—James R. McDaniel
*Attorney, Agent, or Firm*—Wenderoth, Lind & Ponack

[57] ABSTRACT

A multihead thermal printer comprises a plurality of thermal heads arranged around a platen roller. An ink film associated with each thermal head includes an end mark leaving a length to an end of the ink film at least equal to that of one sheet of recording paper. A device for detecting the end mark is disposed adjacent to each thermal head. When the detecting device detects the end mark, the printer completes the printing of a sheet of recording paper in the process of printing, but stops the feed of a succeeding sheet.

9 Claims, 3 Drawing Sheets

THERMAL PRINTER

BACKGROUND OF THE INVENTION (1) Field of the Invention

The present invention relates to a thermal printer comprising a plurality of thermal heads arranged around a platen roller for carrying out a printing operation by heating the thermal heads to transfer thermally fusible or sublimable ink onto recording paper. In particular, the invention relates to a thermal printer used for multicolor recording such as color printing.

(2) Description of the Prior Art

A thermal printer having a plurality of thermal heads around a platen roller is known as a multihead thermal printer. Different color ink films are provided for the respective thermal heads. The ink films are superposed on recording paper, the thermal heads are pressed against the ink films, and pulses are applied to the thermal heads, whereby inks are selectively fused to effect printing on the recording paper. An image having a selected color tone is formed on the recording paper in a single color or in a combination of colors with the plurality of inks transferred individually or in superposition. The ink films are fed by an ink film feed mechanism to supply the respective thermal heads with different colors. It is necessary to monitor unused amounts of the ink films since the ink films are finite and, after one of the ink films is used up, further printing is of no use. To meet this requirement it is conceivable to provide the multihead thermal printer with an ink film used with a single-head thermal printer and having an end mark at a trailing end thereof, and to detect consumption of the ink film by means of the end mark. Aside from the case in which the end mark is detected when one sheet has just been printed in a single-sheet printing, in other cases there is the problem of the sheet being wasted even if 90% (for example) of printing on that sheet is completed, since the printing operation is discontinued upon detection of the end mark. A large amount of recording paper may be wasted when the end mark is detected in the middle of a continuous printing operation.

OBJECTS OF THE INVENTION

A primary object of the present invention, therefore, is to provide a multihead thermal printer adapted to complete the printing of a sheet of recording paper even when an end mark is detected during the printing of that sheet.

Another object of the invention is to provide a thermal printer adapted to prohibit feed of a further sheet of recording paper when an end mark is detected during a continuous printing operation.

SUMMARY OF THE INVENTION

The above objects are fulfilled according to the present invention by a multihead thermal printer capable of completing the printing of a sheet of recording material when an end mark is detected at any of the thermal heads. The thermal printer includes a feeder for feeding a sheet of recording material to a platen roller. The plate roller supports and transports the recording material through a printing path. A plurality of recording stations are positioned along the printing path adjacent to the platen roller. Each recording station includes a thermal head, an ink film supply reel for supplying an ink film to a position between the thermal head and the platen roller, and an ink film take up reel for taking up the ink film. The take-up reel is synchronized with the rotation of the platen roller so as to move the ink film at the same speed as the recording material. Each ink film has an end mark at a position on the ink film spaced from the trailing end of the ink film by a distance at least equal to the length of the recording material. Each subsequent ink film has an end mark distance greater than the previous end mark distance. The thermal heads are driven so as to transfer ink from the ink films onto the recording material. A sensor or detector is positioned near each supply reel of each recording station to detect the end mark. The thermal printer is controlled so as to complete the recording operation onto the recording material when an end mark is detected, but to prohibit the feed of successive recording materials by the feeder.

The recording stations may comprise first, second, and third stations arranged in series along the path of transport of the recording material.

In a preferred embodiment of the invention, the length between the position where the end mark is marked and the rear end of the ink film provided at the second recording station is greater than that of the ink film provided at the first recording station.

The length between the position where the end mark is marked and the trailing end of the ink film provided at the third recording station may be greater than that of the ink film provided at the second recording station.

The thermal printer may further comprise a display for indicating that the sensor detects the end mark of at least one of the ink films.

According to the present invention, each ink film includes an end mark providing an allowance to effect printing for at least one sheet of recording paper. Consequently, a sheet of recording paper for which a printing operation has been started is continued to be printed to completion even if an end mark is detected during the printing operation. At this time no further sheet is fed for printing. This feature eliminates the possibility of wasting recording paper. It also has the advantage of avoiding the waste of time resulting from incomplete printing.

BRIEF DESCRIPTION OF THE DRAWINGS

The above and other objects and features of the present invention will become apparent from the following description of a preferred embodiment in conjunction with the accompanying drawings, in which.

DETAILED DESCRIPTION OF THE INVENTION

Figure 1:
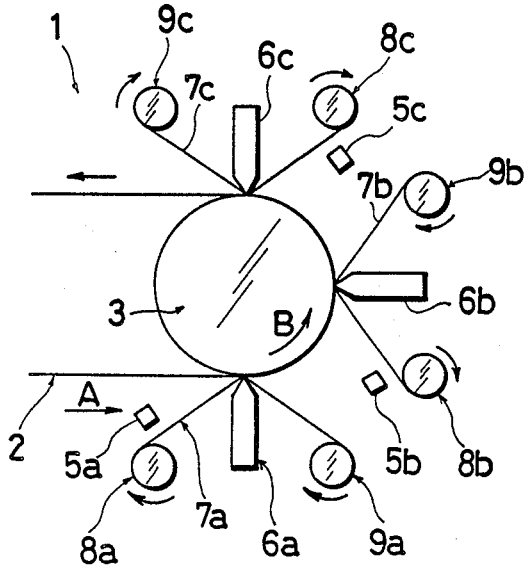
FIG. 1 is a schematic view of a thermal printer embodying the present invention, FIG. 2(*a*) is an elevational view of an ink film used with the thermal printer of FIG. 1, FIG. 2(*b*) is a plan view of the ink film of FIG. 2(*a*)

FIG. 1 schematically shows a thermal printer embodying the present invention. In the drawing, number 1 indicates a three-color printer, which is one example of a thermal printer. This printer 1 comprises a cylindrical platen roller 3 for supporting recording paper 2 would thereon, and first, second and third thermal heads 6a, 6b and 6c arranged around the platen roller 3. First, second and third ink films 7a, 7b and 7c extend from supply reels 8a, 8b and 8c to takeup reels 9a, 9b and 9c via thermal heads 6a, 6b and 6c, respectively. First, second and third "empty" sensors 5a, 5b and 5c are disposed adjacent to the supply reels 8a, 8b and 8c to act as a detecting device for detecting end marks on the ink films 7a, 7b and 7c, respectively.

Figure 2A:
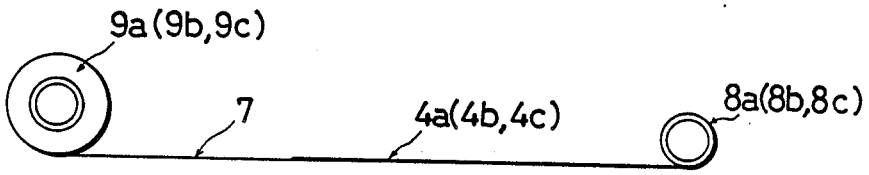
Figure 2B:
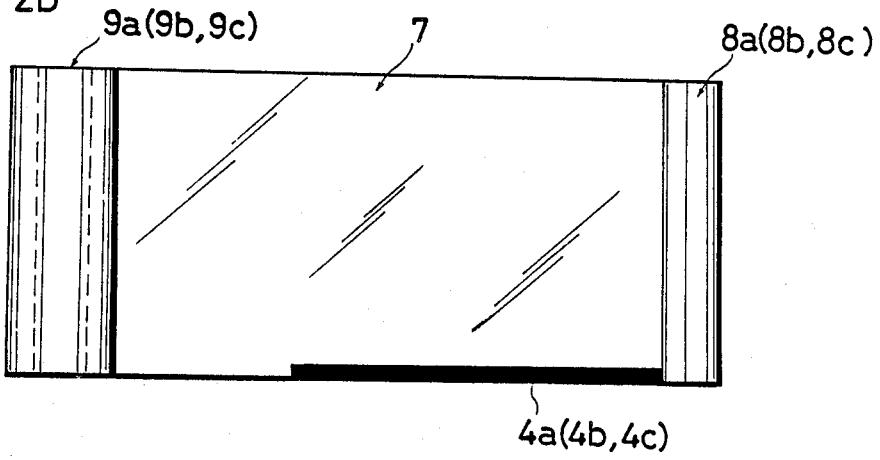

As shown in FIGS. 2(a) and 2(b), each of the ink films 7a, 7b and 7c has a respective end mark 4a, 4b or 4c, consisting of a strip applied to the ink film and extending along a side edge thereof. The end mark 4a, 4b or 4c may be applied to any selected position of the ink film 7a, 7b or 7c so as not to interfere with a printing operation, but should preferably be applied along a side edge as shown in FIG. 2(b). The end mark 4a is applied to the position short of the trailing end of ink film 7a by a length corresponding to one sheet of recording paper. The end mark 4b is applied to the position short of the trailing end of ink film 7b by a length corresponding to one sheet of recording paper plus $\alpha$ ($\alpha>0$). The end mark 4c is applied to the position short of the trailing end of ink film 7c by a length corresponding to one sheet of recording paper plus $\beta$ ($\alpha<\beta$).

Where the printer is capable of handling a variety of paper sizes, the end marks are applied to the ink films on the basis of a maximum size sheet.

The end marks 4a, 4b and 4c of progressively increasing lengths are applied to the ink films 7a, 7b and 7c in the order of arrangement in a paper transport direction for the following reason. When, for example, the end mark 4c on the ink film 7c at the most downstream position with respect to the paper transport direction is detected during a printing operation for which a successive paper feed mode is selected, a successive sheet of paper has already been partly printed. In order to complete the printing of this newly fed sheet of paper through all of the thermal heads 6a, 6b and 6c, the ink film 7c used for printing by the final thermal head 6c must continue to be used for printing not only the sheet currently being printed by the thermal head 6c but also for the succeeding sheet currently being printed by the other thermal heads 6a and 6b. Accordingly, the length corresponding to one sheet of recording paper is insufficient for the end mark 4c applied to the ink film 7c used at the most downstream position. The end mark 4c must have a sufficient length to permit the ink film 7c to print the succeeding paper currently printed by the first and second thermal heads 6a and 6b. Similarly, the end mark 4b on the ink film 7b used at the second thermal head 6b must have a length exceeding that of one sheet. However, since the second thermal head 6b is closer than the third thermal head 6c to the paper feed end (namely, to the first thermal head 6a), the end mark 4b may be correspondingly shorter, and hence $\alpha<\beta$.

Each of the thermal heads 6a, 6b and 6c carries a row of printing elements comprising a plurality of heating elements arranged at fixed intervals. The individual heating elements are selectively electrified to generate joule heat for fusing thermally fusible ink on the ink films 7a, 7b and 7c and transferring the ink to the recording paper 2 to thereby print letters, patterns and the like.

The thermal printer has the first, second and third thermal heads 6a, 6b and 6c arranged circumferentially of the platen roller 3 at an angle of 90 degrees with respect to one another and in the transport direction (referenced by an arrow A in FIG. 1) of recording paper 2. The ink films 7a, 7b and 7c are of yellow, magenta and cyan colors, respectively.

Figure 3:
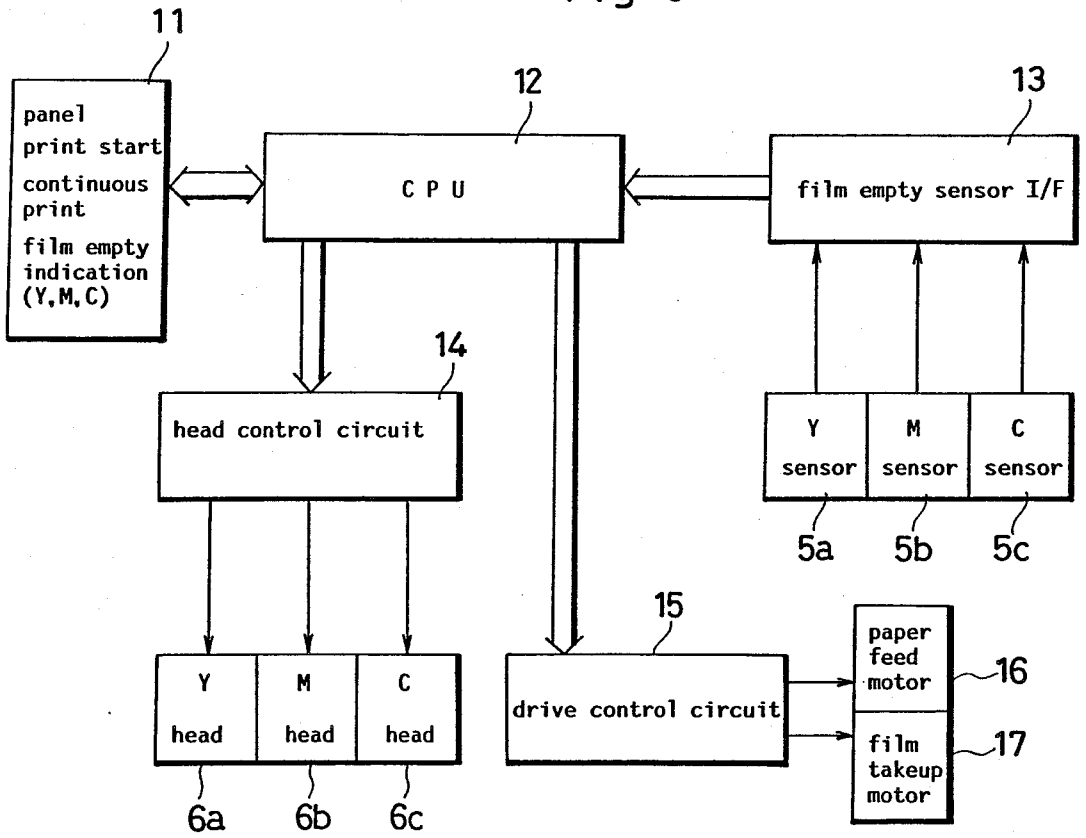
FIG. 3 is a block diagram of a control system for operating the thermal printer of FIG. 1, FIG. 4(*a*) is a flowchart illustrating the start of a printing operation, and FIG. 4(*b*) is a flowchart of a subroutine shown in FIG. 4(*a*).

FIG. 3 is a block diagram of a control system for operating the thermal printer as constructed above to carry out color printing. The control system comprises a panel 11, a CPU 12, an interface I/F 13, a thermal head control circuit 14, and a drive control circuit 15. Number 16 in FIG. 3 indicates a paper feed motor for feeding recording paper 2. Number 17 indicates a motor for driving the takeup reels 9a, 9b and 9c to take up the first, second and third ink films 7a, 7b and 7c.

Figure 4A:
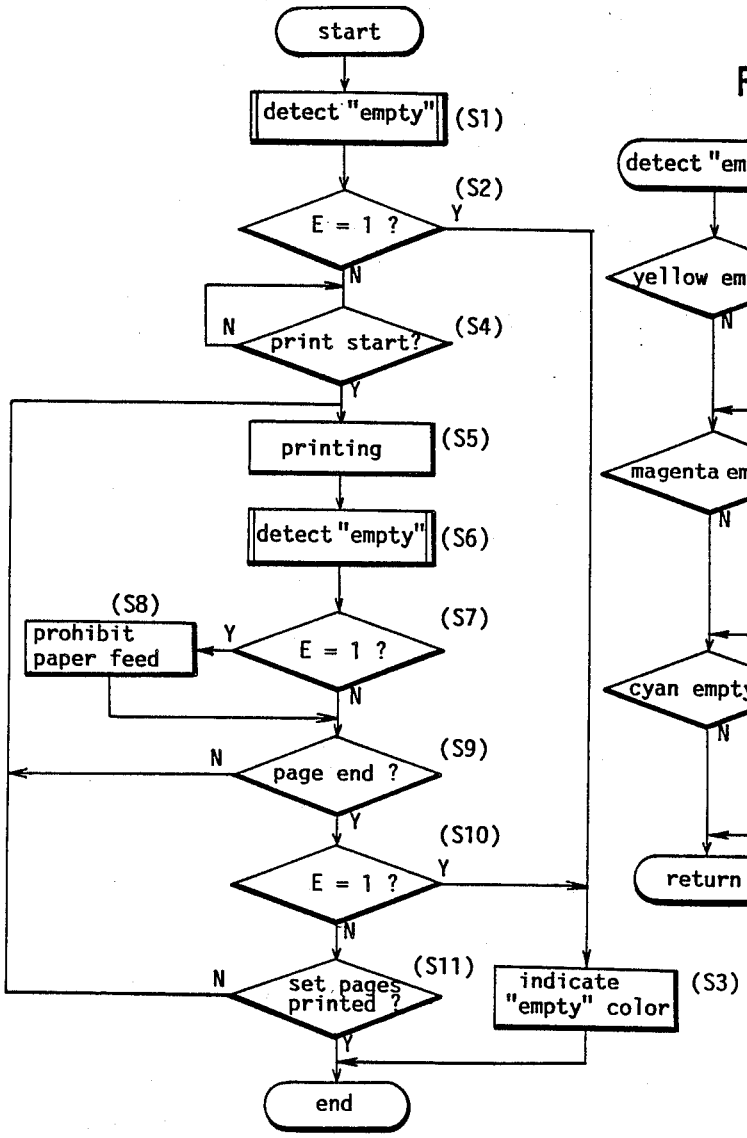
Figure 4B:
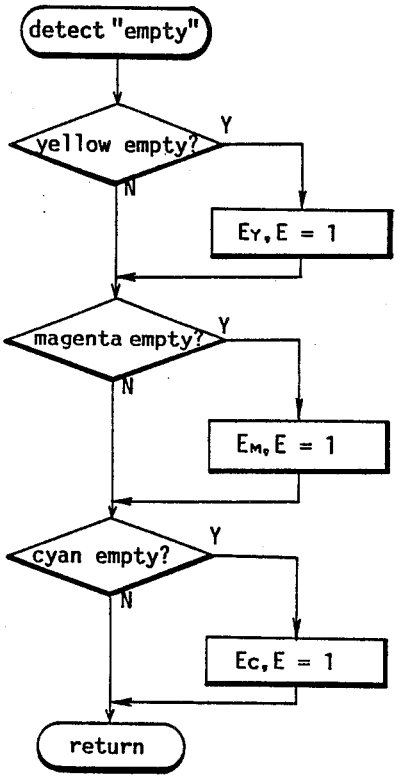

How this control system operates is illustrated by the flowchart of FIG. 4. When power is switched on, detection of the end marks 4a, 4b and 4c is carried out first at step S1. This "empty" detection is carried out by a subroutine as shown in FIG. 4(b). If any of the "empty" sensors 5a, 5b and 5c detects the end mark 4a, 4b or 4c, a corresponding flag is set. Next, step S2 judges whether or not any flag is set. If a flag is set, the program moves to step S3 to give an "empty" indication and comes to an end without starting a printing operation. If, on the other hand, step S2 finds no flag set, the program moves to step S4 to judge whether or not a print start operation has been effected. If it has, the program moves to step S5 for carrying out a selected printing operation, driving the thermal heads 6a, 6b and 6c while rotating the platen roller 3 in the paper feed direction indicated by an arrow B in FIG. 1. The printing operation is a process for printing all colors line by line on a sheet of recording paper. In other words, one line is printed by driving the thermal heads each time the recording paper is transported by one line in the direction indicated by a distance of an arrow A in FIG. 1. For each line printed, the "empty" detection is carried out as above in step S1 by step S6. If any of the sensors 5a, 5b and 5c detects the end mark 4a, 4b or 4c at step S7, the program moves to step S8 to prohibit a further paper feed. The paper feed prohibition is effected by stopping a paper feed mechanism (not shown) only, without stopping the rotation of platen roller 3 and ink film takeup reels 9a, 9b and 9c and the drive of thermal heads 6a, 6b and 6c. The recording paper being printed at this time, therefore, is transported by the platen roller 3 in the direction of arrow A in FIG. 1. Normal printing is of course effected with the ink films whose end marks are not detected. Normal printing is also effected with the ink film whose end mark has been detected by the sensor, since the end mark is at a position short of the trailing end of the ink film at least by the length corresponding to one sheet of recording paper.

If one of the "empty" sensors 5a, 5b and 5c detect the end marks at step S7, step S9 judges whether or not the printing of the one sheet has been completed. If not, the program returns to step 5 to repeat steps S5 through S7. If one sheet printing has been completed, the next step S10 judges whether or not any of the flags corresponding to the respective colors has been set. If no flag is set, the program moves to step S11. When the continuous print mode is selected, step S11 judges whether or not a set number of sheets has been printed. If not, printing is repeated until the set number is reached.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A thermal printer for completing a printing operation of a recording material upon detection of an ink film end mark, comprising:

feeding means for feeding a recording material to be printed;

platen roller means for receiving said recording material from said feeding means and for supporting and transporting said recording material through a printing path;

a plurality of at least two recording stations positioned along said printing path for printing on said recording material, having a first recording station and a second recording station, said second recording station positioned downstream of said first recording station along said printing path in the direction of transport of said recording material;

each said recording station including a thermal head for thermally printing on said recording material and an ink film supply and take-up means for supplying an ink film to a printing position between said thermal head and said platen roller means and for taking up said ink film at a rate equal to the rate of transport of said recording material;

a first ink film provided at said first recording station, an ink film end mark positioned on said first ink film at a distance from the trailing end of said first ink film at least equal to the length of said recording material;

a second ink film provided at said second recording station, an ink film end mark positioned on said second ink film at a distance from the trailing end of said second ink film greater than said first ink film end mark distance;

detecting means for detecting said respective end marks of said first and second ink films; and control means for completing a printing operation of a recording material but prohibiting said feeding means from feeding a successive recording material in response to said detecting means detecting a said end mark of said first or said second ink film;

whereby the position of said first ink film end mark at least equal to said length of said recording material enables said first recording station to complete printing of a recording material being printed at the time of detection of said first ink film end mark, and the position of said second ink film end mark greater than said first ink film end mark distance enables said second recording station to complete printing of a recording material being printed at the time of detection of said second ink film end mark or said first ink film end mark.

2. The thermal printer as set forth in claim 1, wherein said second ink film end mark distance is greater than said first ink film end mark distance by an amount corresponding to the distance between said first recording station and said second recording station.

3. The thermal printer as set forth in claim 1, wherein:

there are three said recording stations, the third recording station positioned downstream of said second recording station; and a third ink film is provided at said third recording station, an ink film end mark positioned on said third ink film at a distance from the trailing end of said third ink film greater than said second ink film end mark distance.

4. The thermal printer as set forth in claim 3, wherein said third ink film end mark distance is greater than said second ink film end mark distance by an amount corresponding to the distance between said second recording station and said third recording station.

5. The thermal printer as set forth in claim 4 wherein said first, second, and third ink films are provided with yellow, magenta, and cyan inks, respectively.

6. The thermal printer as set forth in claim 3, wherein said platen roller means is a platen roller having said recording stations positioned about the circumference of said platen roller, said first recording station and said second recording station being at a 90° angle with respect to each other, and said second recording station and said third recording station being at a 90° angle with respect to each other.

7. The thermal printer as set forth in claim 1, and further comprising display means for indicating detection of one of said ink film end marks.

8. The thermal printer as set forth in claim 1, wherein each said ink film supply and take-up means comprises an ink film supply reel and an ink film take-up reel.

9. The thermal printer as set forth in claim 8, wherein said detecting means comprises a detector at each said recording station, each said detector being positioned closer to the respective ink film supply reel than to the respective thermal head.

* * * * *